United States Patent [19]

Miller et al.

[11] Patent Number: 4,776,478

[45] Date of Patent: Oct. 11, 1988

[54] WASTEBASKET WITH INWARDLY SWINGING LID

[75] Inventors: David C. Miller, Ridgefield; Thomas J. Pendleton, Danbury, both of Conn.

[73] Assignee: Mobil Oil Corporation, New York, N.Y.

[21] Appl. No.: 109,876

[22] Filed: Oct. 19, 1987

[51] Int. Cl.[4] ..... B65D 90/00

[52] U.S. Cl. ..... 220/1 T; 220/337; 220/335

[58] Field of Search ..... 220/1 T, 334, 335, 337; 232/43.2

[56] References Cited

U.S. PATENT DOCUMENTS

| | | | |
|---|---|---|---|
| 1,037,265 | 9/1912 | Kirkpatrick . | |
| 2,145,613 | 1/1939 | Shenk et al. . | |
| 2,421,740 | 6/1947 | Birch, Jr. . | |
| 2,987,216 | 10/1961 | Fletcher . | |
| 3,204,866 | 9/1965 | Brighton et al. . | |
| 3,443,745 | 5/1969 | Kleeberg . | |
| 3,529,766 | 9/1970 | Mott, Sr. et al. . | |
| 3,556,395 | 1/1971 | Herman | 232/43.2 |
| 3,563,452 | 2/1971 | Cantella | 232/43.2 |
| 3,603,542 | 9/1971 | Grille . | |
| 3,653,620 | 4/1972 | Benoit . | |
| 3,658,233 | 4/1972 | Voytko | 220/1 T |
| 3,779,419 | 12/1973 | Heitz | 220/85 B |
| 3,827,348 | 8/1974 | Hennells | 100/53 |
| 3,954,203 | 5/1976 | Jorgenson et al. | 220/334 |
| 4,032,037 | 6/1977 | Dubery et al. | 220/335 |
| 4,069,965 | 1/1978 | Maddox, Jr. . | |
| 4,098,429 | 7/1978 | Hodge | 220/331 |
| 4,126,241 | 1/1978 | Klosk | 220/1 T |
| 4,128,055 | 12/1978 | Hellmann . | |
| 4,212,407 | 7/1980 | Lydon | 220/1 T |
| 4,234,096 | 11/1980 | Hergaux | 220/1 T |
| 4,338,979 | 7/1982 | Dow . | |
| 4,448,327 | 5/1984 | Gahm . | |
| 4,488,697 | 12/1984 | Garvey . | |
| 4,550,440 | 10/1985 | Rico . | |
| 4,580,688 | 4/1986 | Harris et al. | 220/1 T |
| 4,598,838 | 7/1986 | Zakrajsek . | |
| 4,649,813 | 3/1987 | Kehl | 100/227 |
| 4,679,700 | 7/1987 | Tharrington et al. | 220/337 |

FOREIGN PATENT DOCUMENTS

| | | |
|---|---|---|
| 478788 | 11/1951 | Canada . |
| 400890 | 10/1965 | Switzerland . |

*Primary Examiner*—George T. Hall

*Attorney, Agent, or Firm*—Alexander J. McKillop; Michael G. Gilman; Charles J. Speciale

[57] ABSTRACT

A wastebasket includes a container and a lid which is mounted on the container. The container is formed with an opening providing access to the container's interior. The lid is pivotable about a pivot axis to cover and at least partially uncover the container opening. The pivot axis divides the lid into a forward portion and a rearward portion which are respectively disposed on opposite forward and rearward sides of a vertical plane encompassing the pivot axis when the lid is in a position covering the container opening. The forward portion of the lid has a greater cross-sectional area than the rearward portion, and the rearward portion has a greater weight than the forward portion. The lid is pivotable between a first position, where the lid substantially covers the container opening, and a second position, where the forward portion of the lid is disposed inwardly of the container and uncovers at least a portion of the container opening.

15 Claims, 4 Drawing Sheets

Fig. 2
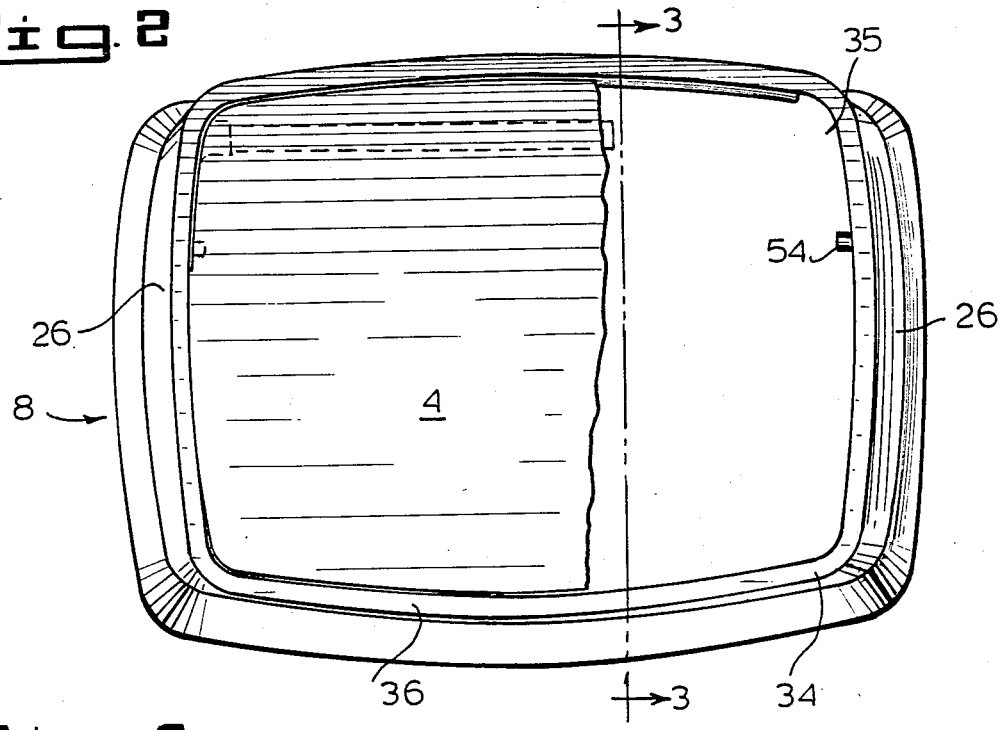
Fig. 6
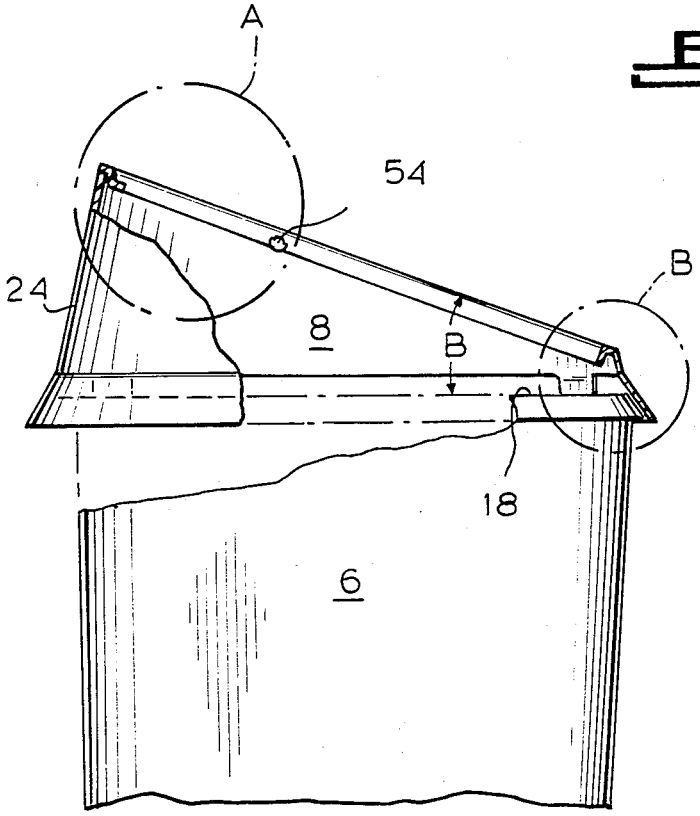
Fig. 7
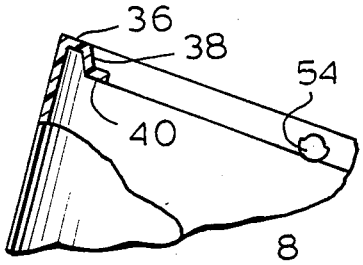
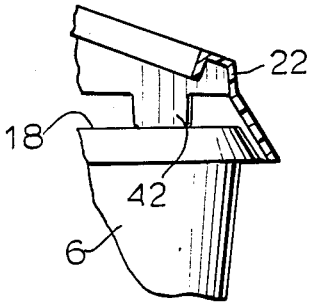
Fig. 8

WASTEBASKET WITH INWARDLY SWINGING LID

BACKGROUND OF THE INVENTION

1. Field of the Invention

The present invention relates to wastebaskets or trash receptacles, and more particularly relates to a wastebasket having a lid which swings inwardly of the wastebasket and returns by gravity to a closed position.

2. Description of the Prior Art

Wastebaskets or trash receptacles which have inwardly swinging lids are well-known in the art, as disclosed in U.S. Pat. No. 4,032,037, which issued to Roy Dubery et al. The wastebasket disclosed in the Dubery et al. patent has an advantage over many swinging lid wastebaskets in that its lid, when swung inwardly of the wastebasket, is automatically held in the open position until closed by the user.

As shown in FIG. 2 of the Dubery et al. patent, the lid 14 includes a lever arm 30 which is disposed substantially at a right angle to the rest of the lid. A metal strip 34 is fastened to the free end of the lever arm 30. Positioned on the inside top surface of the receptacle above the metal strip 34 is a magnet 40. When the lid is swung inwardly, the lever arm rises until the metal strip 34 engages magnet 40. The attraction of the metal strip to the magnet holds the lid open.

In an alternative embodiment shown in FIG. 4 of the Dubery et al. patent, a lid catch 50 extends downwardly inside the wastebasket and is received by a slot 52 formed in the lid lever arm 30. When the lid swings inwardly, the lid catch 50 engages an edge of the slot 52 and holds the lid open.

In the Dubery et al. trash receptacle, a depressible plunger 48 is provided for disengaging the metal strip 34 from the magnet 40 or for disengaging the lid from the lid catch 50 in the alternative embodiment. The lid swings back to its normally closed position covering the opening in the receptacle under the influence of the weight of metal strip 34, or alternatively, a counterweight 56 attached to the lever arm.

A distinct disadvantage of the receptacle of the Dubery et al. patent is its mechanical complexity. A lid release mechanism and either the magnet 40 or the lid catch 50 are provided to maintain the lid in an open position and to release the lid when desired so that the lid returns by gravity to a closed position covering the receptacle. Thus, the Dubery et al. trash receptacle is relatively expensive to manufacture and assemble. Furthermore, the complexity of the Dubery et al. receptacle makes it difficult for the consumer to clean. The mechanism for keeping the lid open and for releasing the lid so that it closes by gravity may become so soiled that it fails to operate properly.

OBJECTS AND SUMMARY OF THE INVENTION

It is an object of the present invention to provide a wastebasket or trash receptacle having an inwardly swinging lid which, if desired, may be maintained in an open position.

It is another object of the present invention to provide a wastebasket with a swinging lid, which wastebasket is mechanically simple and easy to assemble.

It is yet a further object of the present invention to provide a wastebasket which can be readily disassembled by the ultimate user for cleaning.

It is a still further object of the present invention to provide a wastebasket having a swinging lid that may be maintained in an open position, which lid is the only moving part of the wastebasket.

It is yet another object of the present invention to provide a wastebasket which overcomes the inherent disadvantages of known wastebaskets and trash receptacles having swinging lids, such as that disclosed in Dubery et al. U.S. Pat. No. 4,032,037.

In accordance with one form of the present invention, a wastebasket includes a container and a lid which is pivotally mounted on the container. The container is formed as two separable components: a lower container portion and a hood mounted on the lower container portion. The container includes a top opening which is formed in its hood, and the lid is pivotally mounted on the hood at the top opening, and swings inwardly of the container to cover and uncover the top opening.

The lid is preferably pivotally mounted on opposite lateral sides of the hood at pivot points close to the back of the hood to provide a large access opening to the container. The lid includes a protruding lip which extends outwardly along its front side and along its two lateral sides up to the lid pivot points.

The hood of the container is sloped downwardly from back to front at its top opening, and includes a rim which encircles the top opening. The rim engages the lip of the lid and limits its swing so that the lid can only pivot inwardly of the container.

A counterweight is mounted on the inside surface of the lid near its rear edge, and is provided for returning the lid to its closed position, i.e., covering the top opening, or for maintaining the lid in an inwardly disposed, open position, depending on how far the lid is swung into the container.

If the lid is swung only partially into the container, it will close automatically under the influence of the counterweight. If greater force is exerted on the lid to cause it to swing further into the container so that the counterweight pivots forwardly of the lid pivot points, the lid will stay open until manually returned to its closed position.

A preferred form of the wastebasket, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 2 is a top plan view of the wastebasket shown in FIG. 1.

FIG. 6 is a side view of the wastebasket of FIG. 1, partially broken away.

FIG. 7 is an enlarged view of the portion of the wastebasket shown in circle A of FIG. 6.

FIG. 8 is an enlarged view of the portion of the wastebasket shown in circle B of FIG. 6.

DETAILED DESCRIPTION OF THE PREFERRED EMBODIMENTS

Figure 1:
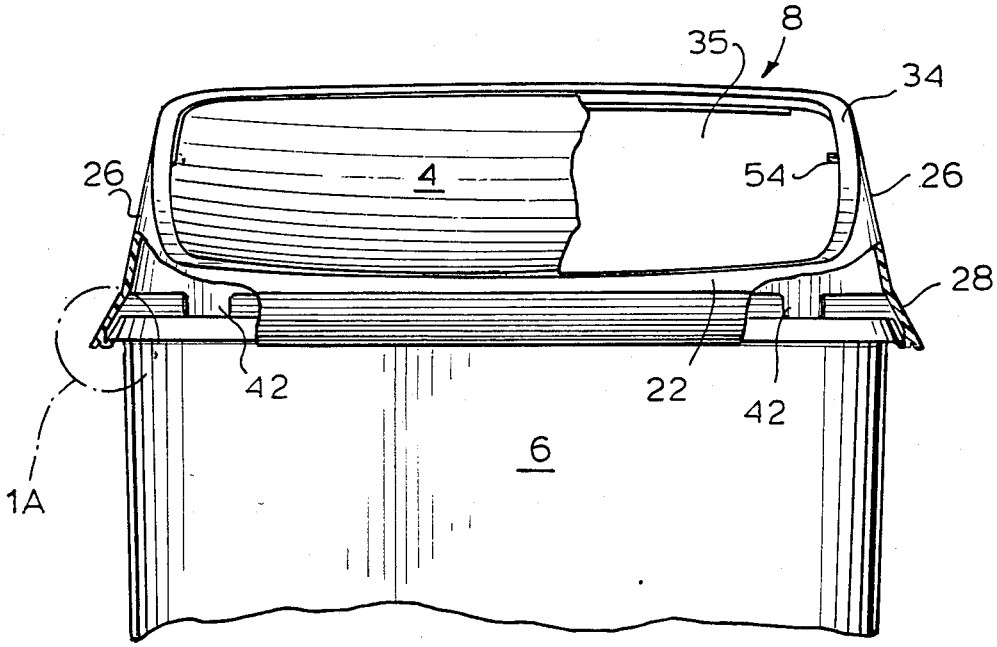
FIG. 1 is a front view of the upper portion of a wastebasket constructed in accordance with one form of the present invention.

Referring now to FIGS. 1–8 of the drawings, it will be seen that a wastebasket constructed in accordance with one form of the present invention basically includes a container 2 and a lid 4 mounted on the container.

The container 2 is formed in two separable parts: a lower conainer portion 6 and a hood 8 mounted on the lower container portion.

The lower container portion 6 is formed as an open receptacle for receiving and holding refuse. It includes interconnected side walls 10 and a bottom 12, and has an overall rectangular shape in cross-section. The upper edges of the side walls 10 define a top opening 14, and project outwardly from the lower container portion to also define a rim 16 surrounding the top opening. The rim 16 is formed with a flat, horizontal portion 18 and a downwardly sloping edge portion 20 extending from the horizontal portion. The rim 16 strengthens the lower container portion and, as will be described, provides a supporting surface for the hood.

The lower container portion 6 is adapted to receive an inner liner (not shown). The open end portion of the inner liner may be draped over the rim 16 of the lower container portion. The hood 8, mounted on the rim of the lower container portion, helps hold the inner liner in place.

The hood 8 of the container mounts on the rim 16 of the lower container portion and can be removed for cleaning or for replacing inner liners. It includes a front wall 22 and a back wall 24 and opposite lateral walls 26. The walls 22–26 conform to the overall shape of the lower container portion 6, so that the hood 8 appears as an extension of the lower portion 6. The hood walls 22–26 may have a slightly inward taper. For example, the back wall 24 may be sloped inwardly at an angle A of about 70° to the horizontal or to the rim 16 of the lower container portion.

The lower edges of the hood walls 22–26 are turned outwardly to define a lower rim 28 which fits over and hides the rim 16 of the lower container portion. The lower rim 28 of the hood is sloped at the same angle as the downwardly sloping edge portion 20 of the lower container portion's rim so that the two parallel each other entirely around the periphery of the wastebasket.

Figure 1A:
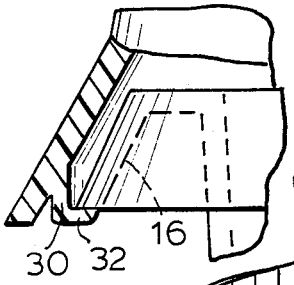
FIG. 1A is an enlarged, detailed view of a portion of the wastebasket shown in circle 1A of FIG. 1.
Figure 5:
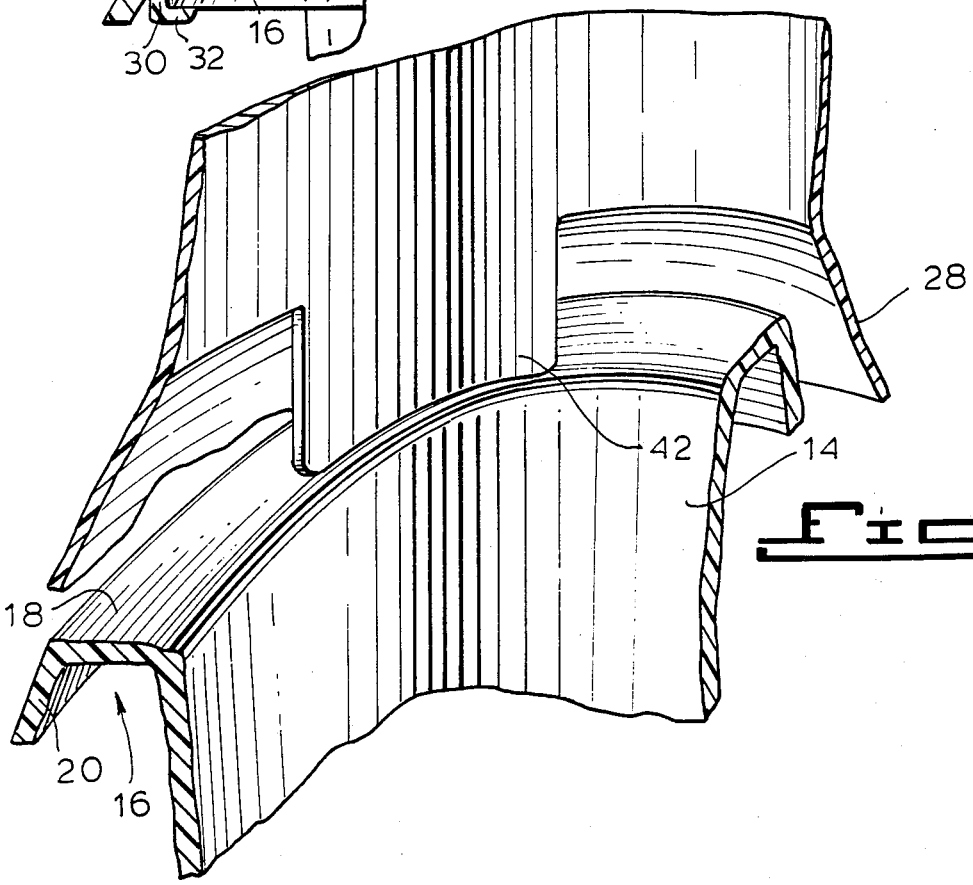
FIG. 5 is a perspective view of a corner section of the wastebasket of FIG. 1.
Figure 3:
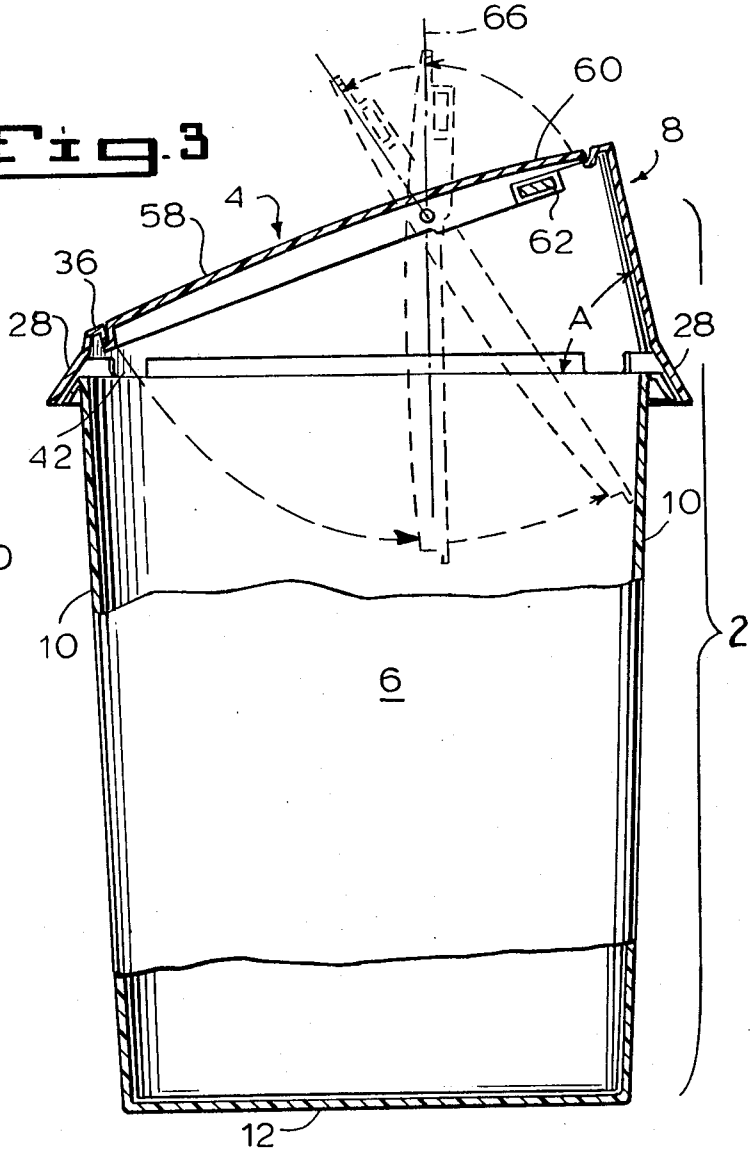
FIG. 3 is a sectional view of the wastebasket shown in FIG. 1, taken along line 3—3 of FIG. 2.
Figure 4:
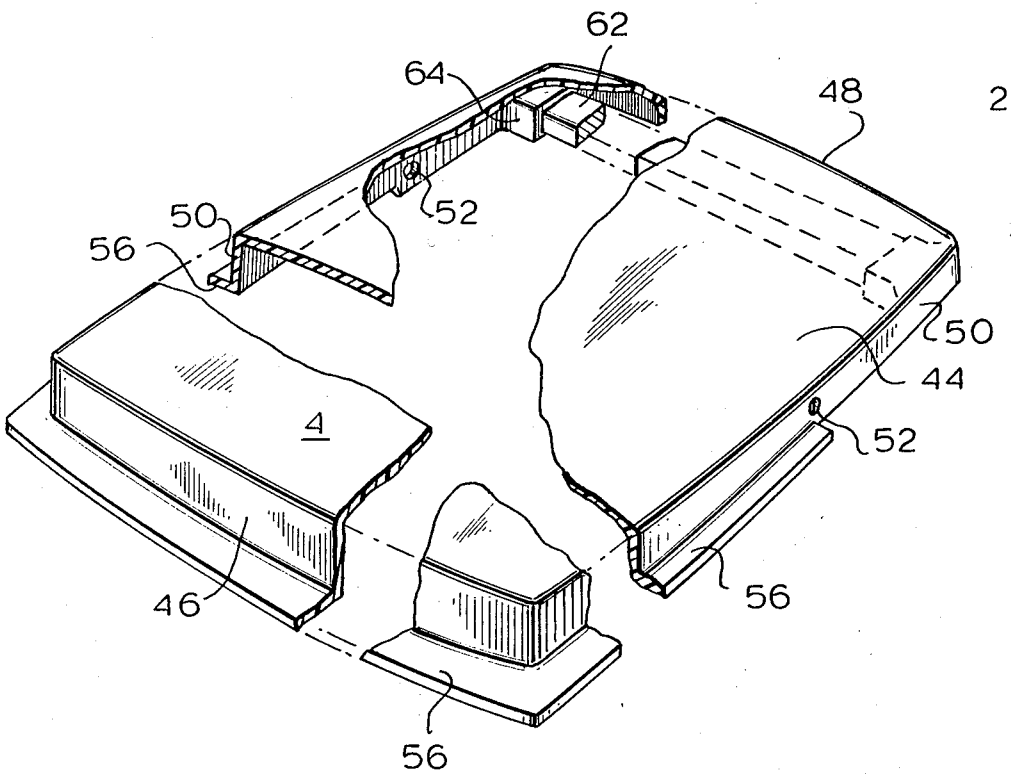
FIG. 4 is a perspective view of the lid of the wastebasket shown in FIG. 1 with the lid partially broken away.

The hood 8 may include structure for selectively latching the hood to the lower container portion 6, as shown in FIG. 1A. A pair of resilient tabs 30 having inwardly turned, hooked ends 32 project downwardly from the lower rim 28 of the hood on its lateral walls 26. The hooked ends 32 of the tabs snap into engagement with the bottom edges of the lower container portion's rim 16 when the hood is pressed down onto the lower container portion. This secures the hood to the lower container portion. To remove the hood 8, one merely presses inwardly on the lateral walls 26 of the hood, which causes the tabs 30 to pivot outwardly so that the hooked ends 32 disengage from the rim 16 of the lower container portion.

The hood 8 also includes an upper rim 34 joined to the upper edges of the hood walls 22–26. The upper rim 34 surrounds and thus defines a top opening 35 in the hood, which opening provides access to the lower container portion when the hood is mounted thereon.

The hood upper rim 34 is formed with a top surface wall 36 extending inwardly of the hood walls 22–26, and downwardly projecting inner walls 38 extending from the top surface wall. The top surface wall 36 of the hood upper rim is preferably sloped downwardly from the back wall 24 of the hood to the front wall 22, that is, at an angle B of about 30° to the horizontal or to the lower container portion's rim 16, so that it provides a more visible and accessible top opening for the user. The rim 34 further includes a lip 40 extending inwardly and parallel to the top wall 36 from a portion of the inner walls 38 situated at the back wall 24 of the hood. The lip 40 provides a seat for the lid, as will be described.

The hood 8 also includes support legs 42 which extend downwardly from the walls 22–26 of the hood and are joined to the walls near where the walls turn outwardly to define the lower rim 28. The legs 42 are situated so that they rest on the horizontal portion 18 of the lower container portion's rim near the four corners of the container. The legs 42 support the hood vertically on the lower container, and the hood lower rim 28 cooperatingly overlaps the lower container portion's rim 16 to prevent dislodgement of the hood and to help guide the hood into proper alignment with the lower container portion when the hood is fitted thereon. The legs 42 also engage the inner liner draped over the lower container rim 16 and help keep the liner in place.

The lid 4 has an overall planar shape, and includes a top wall 44 and interconnected front 46, rear 48 and side walls 50 surrounding the top wall. A hole 52 is formed through the thickness of each lid side wall 50. Corresponding mounting pins 54 are co-axially situated on opposite inner walls 38 of the hood upper rim, and are positioned closer to the back wall 24 of the hood than to the front wall 22, preferably at about ⅓ or ¼ of the hood's front-to-back length from the back wall. The mounting pins 54 are received in the lid holes 52 when the lid is mounted on the hood to cover the top opening. The lid 4, when mounted on the hood pins 54, swings inwardly of the container about a pivot axis defined by the pins. Positioning the mounting pins 54 more towards the back of the hood provides a larger area of the top opening 35 which is uncovered when the lid swings inwardly.

The lid 4 further includes a lip 56 which is recessed below the top wall 44 and which extends outwardly from the front wall 46 of the lid and from portions of the side walls 50 situated between the front wall and the lid mounting holes 52. When the lid is properly mounted on the hood and disposed in a position covering the top opening, the lid lip 56 engages the upper rim 34 of the hood, and the bottom edge of the lid rear wall 48 is seated on the hood lip 40 so that the top wall 36 of the lid is substantially flush with the hood upper rim 34. The engagement of the lid lip 56 and hood rim 34, and lid rear wall 48 and hood lip 40, prevents the lid from swinging outwardly of the container when a downward force is applied to that portion of the lid situated rearwardly of the pivot axis, and provides a partial seal between the lid and the container to help prevent refuse odors from escaping.

The axis about which the lid pivots divides the lid into a forward portion 58 and a rearward portion 60. Because the lid pivot axis is situated substantially rearwardly of the container, the lid's forward portion 58 covers a much greater area than the rearward portion 60. When a downward force is exerted on the forward portion of the lid, it swings inwardly of the container and uncovers a major portion of the top opening 35, thus defining a greater access opening for the user.

The lid further includes a counterweight 62 disposed on the underside of the top wall 44 at the rearward portion 60 of the lid. The counterweight 62 is preferably an elongated metal bar. Two rectangular formations 64 facing each other on opposite side walls 50 of the lid define sockets for receiving the ends of the counterweight 62 and for retaining the counterweight in place on the underside of the lid.

The weight of the counterweight 62 is chosen to offset the weight of the forward portion 58 of the lid so that the lid will automatically return to a closed position covering the top opening 35. More specifically, the combined weight of the counterweight 62 and rearward portion 60 of the lid is selected to be greater than the weight of the forward portion 58 of the lid.

If the lid is swung only partially into the container, so that the forward and rearward portions 58, 60 of the lid remain on their respective sides of an imaginary vertical plane 66 in which the pivot axis resides, it will close automatically by gravity and reseat itself against the hood's upper rim 34 under the influence of the counterweight 62, as the weight of the rearward portion of the lid and counterweight is greater than that of the forward portion.

However, if greater force is exerted on the lid to cause its forward and rearward portions 58, 60 to swing to opposite sides of the pivot axis plane 66 (i.e., the forward and rearward portions are now respectively disposed rearwardly and forwardly of the pivot axis plane), the greater weight of the rearward portion 60 (and counterweight 62) will maintain the lid in an open position substantially transversely to the upper rim 34 of the hood, with the lid lip 56 in engagement with the container side wall 10.

When the lid is in such an open position and the user wishes to close the lid, he merely exerts sufficient force on the rearward portion 60 of the lid to displace it back to the rearward side of the pivot axis plane; the weight of the rearward portion 60 (and counterweight 62) will automatically return the lid to the closed position covering the top opening 35.

Figure 9:
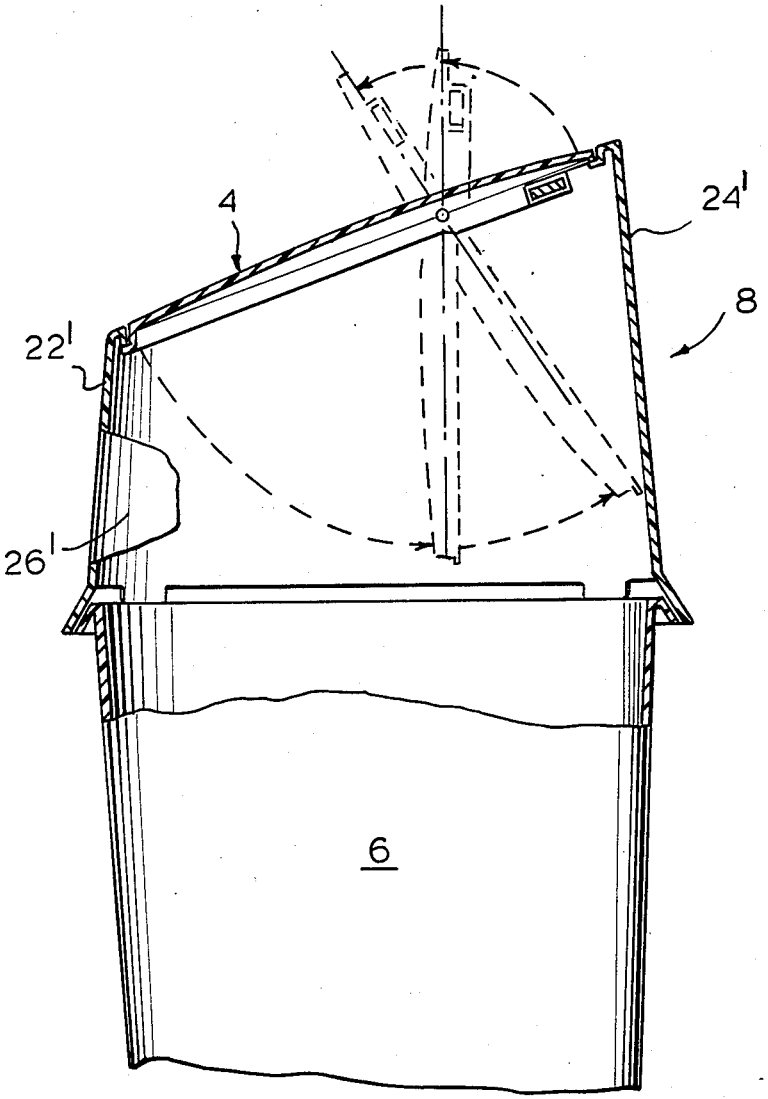
FIG. 9 is a partial sectional view of an alternative form of the wastebasket of the present invention.

An alternative form of the wastebasket previously described is shown in FIG. 9. The lower container portion 6, lid 4 and hood 8 are substantially the same as in the previous embodiment except that the hood front wall 22', back wall 24' and lateral walls 26' are extended to provide the hood with a greater height and depth inside. Preferably, the height of the hood, or vertical distance between the lid mounting pins 54 and the rim 16 of the lower container portion, is at least equal to the distance from the lid mounting apertures 52 to the front edge of the lid lip 56, or the length of the lid's forward portion 58.

Constructing the hood with such height is advantageous because the lid can now swing inwardly of the container to the depth of the hood. That is, the lid 4 will not swing below the rim 16 of the lower container portion, as illustrated by the dashed lines in FIG. 9. When the lid is fully opened, the front edge of its lid lip 56 will rest against the back wall 26' of the hood. Thus, the lid will not interfere with the refuse held by the lower container portion when the lid swings inwardly This provides more usable space in the wastebasket for receiving refuse, so that the inner liner may be filled to the top before it must be replaced.

As is evident from the above description, the wastebasket of the present invention is constructed with very few parts and only one moving part—the lid. Because the wastebasket is simple in construction, it requires little assembly and its manufacturing costs are minimized.

The wastebasket may be disassembled easily by removing the hood from the lower container portion, so that the user can easily clean the wastebasket or remove full inner liners Although much simpler in construction than the wastebasket disclosed in the Dubery et al. patent, the wastebasket of the present invention provides a similar advantageous feature—its lid will close automatically or remain open, as desired by the user.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A wastebasket, which comprises:

a container, the container being formed with an opening providing access to the interior thereof;

a lid, the lid being mounted on the container and being pivotable about a pivot axis to cover and at least partially uncover the container opening, the pivot axis defining forward and rearward portions of the lid respectively disposed on opposite forward and rearward sides of a vertical plane encompassing the pivot axis when the lid is in a position covering the container opening, the forward portion having a greater cross-sectional area than the rearward portion, and the rearward portion having a greater weight than the forward portion; and means for pivotably mounting the lid on the container, the lid being pivotable between a first position, wherein the lid substantially covers the container opening, and a second position, wherein the forward portion is disposed inwardly of the container and uncovers at least a portion of the container opening.

2. A wastebasket as defined by claim 1, wherein the rearward portion of the lid includes a counterweight mounted thereon.

3. A wastebasket as defined by claim 1, wherein the container includes a lower container portion and a hood removably mounted on the lower container portion, the container opening being formed in the hood.

4. A wastebasket as defined by claim 3, wherein the hood includes an upper rim surrounding the container opening, the lid being mounted on the container at the hood uppe rim.

5. A wastebasket as defined by claim 4, wherein the hood upper rim is sloped from a horizontal plane.

6. A wastebasket as defined by claim 4, wherein the means for pivotally mounting the lid to the container includes a pair of pins extending outwardly from opposite sides of the hood upper rim, the pins being received in corresponding apertures formed in the lid.

7. A wastebasket as defined by claim 4, wherein the lid includes a lip on at least one edge thereof which engages the hood upper rim.

8. A wastebasket as defined by claim 7, wherein the lid is substantially planar and includes a top wall; and wherein the lip is recessed from the top wall of the lid so that the top wall of the lid is substantially flush with the hood upper rim when the lid is in the first position.

9. A wastebasket as defined by claim 3, wherein the lower container portion includes a rim formed with a downwardly and outwardly sloping edge portion; and wherein the hood includes a lower rim situated at the lower portion thereof, the hood lower rim being formed as a downwardly and outwardly extending member which is adapted to fit over the rim of the lower container portion when the hood is mounted thereon.

10. A wastebasket as defined by claim 3, wherein the lower container portion includes an upper rim situated at the upper portion thereof; and wherein the hood includes a plurality of legs projecting downwardly from the lower portion thereof, the legs being adapted to engage the rim of the lower container portion to support the hood thereon.

11. A wastebasket as defined by claim 3, wherein the hood includes means for selectively latching the hood to the lower container portion.

12. A wastebasket as defined by claim 11, wherein the hood latching means includes a resilient tab projecting downwardly from a lower portion of the hood, the tabs including hooked ends which are adapted to engage the lower container portion to secure the hood thereto.

13. A wastebasket as defined by claim 3, wherein the lid is pivotally mounted on the hood; and wherein the height of the hood measured from where the lid is mounted to the lower container portion is at least substantially equal to the length of the forward portion of the lid.

14. A wastebasket as defined by claim 6, wherein the vertical distance from the mounting pins to the lower container portion rim is at least substantially equal to the distance from the lid apertures to the front edge of the forward portion of the lid.

15. A wastebasket, which comprises:

a container, the container being formed with an opening providing access to the interior thereof; and a lid, the lid being mounted on the container and being pivotable about a pivot axis to cover and at least partially uncover the container opening, the pivot axis defining forward and rearward portions of the lid respectively disposed on opposite forward and rearward sides of a vertical plane encompassing the pivot axis when the lid is in a position covering the container opening, the forward portion having a greater cross-sectional area than the rearward portion, and the rearward portion having a greater weight than the forward portion, wherein the lid is adapted to return by gravity to a first position covering the opening when the lid is pivoted to a position where the forward and rearward portions thereof respectively reside on forward and rearward sides of the vertical plane encompassing the pivot axis, and wherein the lid is adapted to remain in a second position substantially uncovering the opening when the lid is pivoted to a position where the forward and rearward portions thereof respectively reside on rearward and forward sides of the vertical plane encompassing the pivot axis.

* * * * *